US006676050B2

(12) United States Patent
Chang

(10) Patent No.: US 6,676,050 B2
(45) Date of Patent: Jan. 13, 2004

(54) PAPER SHREDDER HAVING THE FUNCTION OF BREAKING A COMPACT DISC

(76) Inventor: Frank Chang, 3F., 200, Sin-Yi Rd., Sec. 3, Taipei (TW), 106

( * ) Notice: Subject to any disclaimer, the term of this patent is extended or adjusted under 35 U.S.C. 154(b) by 208 days.

(21) Appl. No.: 09/938,738

(22) Filed: Aug. 27, 2001

(65) Prior Publication Data

US 2003/0006330 A1 Jan. 9, 2003

(51) Int. Cl.[7] ..... B02C 18/22
(52) U.S. Cl. ..... 241/37.5; 241/100; 241/236
(58) Field of Search ..... 211/36, 37.5, 100, 211/236

(56) References Cited

U.S. PATENT DOCUMENTS 4,817,877 A * 4/1989 Itoh et al. ..... 241/34
5,188,301 A * 2/1993 Hasegawa ..... 241/33
6,065,696 A * 5/2000 Tsai ..... 241/37.5
6,550,701 B1 * 4/2003 Chang ..... 241/36

* cited by examiner

*Primary Examiner*—Mark Rosenbaum
(74) *Attorney, Agent, or Firm*—Dennison, Schultz & Dougherty

(57) ABSTRACT

A paper shredder having the function of breaking a compact disc includes juxtaposed first and second rolling blade wheels which are used for shredding paper, and rotated relative to each other. The paper shredder is additionally provided with a third rolling blade wheel that is especially used for breaking a compact disc or a credit card. The surface of the housing of the paper shredder is provided with a paper inlet and a compact disc inlet. The paper may be passed through and shredded by the first rolling blade wheel and the second rolling blade wheel. The compact disc or credit card may be passed through and broken by the second rolling blade wheel and the third rolling blade wheel.

4 Claims, 5 Drawing Sheets

PAPER SHREDDER HAVING THE FUNCTION OF BREAKING A COMPACT DISC

BACKGROUND OF INVENTION

1. Field of the Invention

The present invention relates to a paper shredder having the function of breaking a compact disc, and more particularly to a paper shredder that may have a double function to shred the paper and break the data of the compact disc.

2. Description of the Related Art

A conventional paper shredder may be used to shred paper so as to destroy the data printed on the surface of the paper, thereby preventing from revealing the secret. However, the conventional paper shredder cannot be used to break a storage medium such as a compact disc. When the compact disc is useless, the user may break the compact disc, and then throw it away. However, the data on the compact disc may be read out if the broken extent of the compact disc is slight, so that the data on the compact disc easily reveals. In addition, the broken fragments of the compact disc easily hurt the user's body.

When the conventional paper shredder is used to break the compact disc, the conventional paper shredder needs to have a strong power and rigid rolling blade wheels so as to break the compact disc, thereby greatly increasing the cost of production.

SUMMARY OF INVENTION

The present invention has arisen to mitigate and/or obviate the disadvantage of the conventional paper shredder.

Basically, the compact disc primarily includes a printed layer, a protection layer, a reflective layer, and a plastic base plate. In practice, the user only needs to efficiently break the protection layer and the plastic base plate so that the data on the reflective layer cannot be read out, thereby breaking the data of the compact disc. Thus, the compact disc may be broken by breaking the surface of the compact disc, without having to entirely shred the compact disc.

Accordingly, the present invention is designed to have a third rolling blade wheel which is juxtaposed to the original second rolling blade wheel of the paper shredder, and the surface of the housing of the paper shredder may be provided with a compact disc inlet, so that the paper shredder can be used to shred the paper and can also be used to break the data of the compact disc.

The primary objective of the present invention is to provide a paper shredder having the function of breaking a compact disc, wherein the original second rolling blade wheel of the paper shredder may co-operate with a new designed third rolling blade wheel, to break the surface of the compact disc by scraping, cutting, denting, bending or deforming, thereby destroying the data on the compact disc, so that the paper shredder can be used to shred the paper and can also be used to break the data of the compact disc.

Another objective of the present invention is to provide a paper shredder having the function of breaking a compact disc, including juxtaposed first and second rolling blade wheels which are used for shredding paper, and rotated relative to each other. The paper shredder is additionally provided with a third rolling blade wheel that is especially used for breaking a compact disc or a credit card. The surface of the housing of the paper shredder is provided with a paper inlet and a compact disc inlet. The paper may be passed through and shredded by the first rolling blade wheel and the second rolling blade wheel. The compact disc or credit card may be passed through and broken by the second rolling blade wheel and the third rolling blade wheel. Thus, the paper shredder may have a double function to shred the paper and break the data of the compact disc. A container mounted on the lower portion of the paper shredder is divided into a waste paper zone and a waste compact disc zone by a baffle to receive the shredded paper and broken compact, thereby facilitating recycling and recovering resource.

In accordance with the present invention, there is provided a paper shredder having the function of breaking a compact disc, comprising: a first rolling blade wheel and a second rolling blade wheel which are used for shredding paper, the first rolling blade wheel and the second rolling blade wheel juxtaposed to each other, and rotated relative to each other, a paper shredding zone formed between the first rolling blade wheel and the second rolling blade wheel, a housing above the paper shredding zone formed with a paper inlet aligning with the paper shredding zone, such that paper may be inserted into the paper shredding zone through the paper inlet to be shredded by the first rolling blade wheel and the second rolling blade wheel; wherein, a third rolling blade wheel that is especially used for breaking a compact disc is juxtaposed to the second rolling blade wheel, a compact disc breaking zone is formed between the second rolling blade wheel and the third rolling blade wheel, and the housing is formed with a compact disc inlet aligning with the compact disc breaking zone, such that the compact disc may be inserted into the compact disc breaking zone through the compact disc inlet, and a surface of the compact disc may be broken by the second rolling blade wheel and the third rolling blade wheel, so as to break data on the compact disc.

Further benefits and advantages of the present invention will become apparent after a careful reading of the detailed description with appropriate reference to the accompanying drawings.

DETAILED DESCRIPTIONS OF EMBODIMENTS

Figure 1:
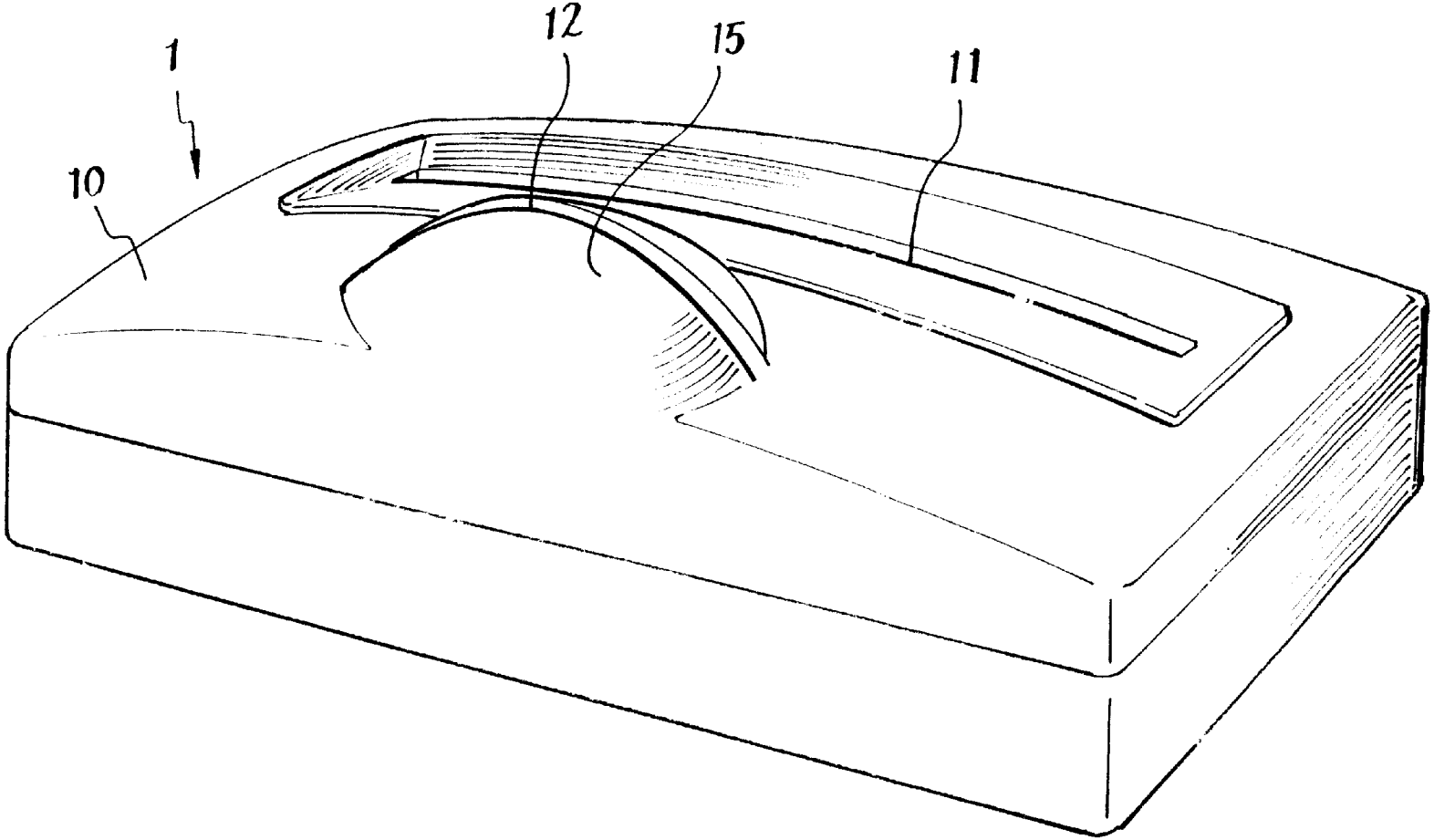
FIG. 1 is a perspective view of a paper shredder having the function of breaking a compact disc in accordance with a preferred embodiment of the present invention.
Figure 2:
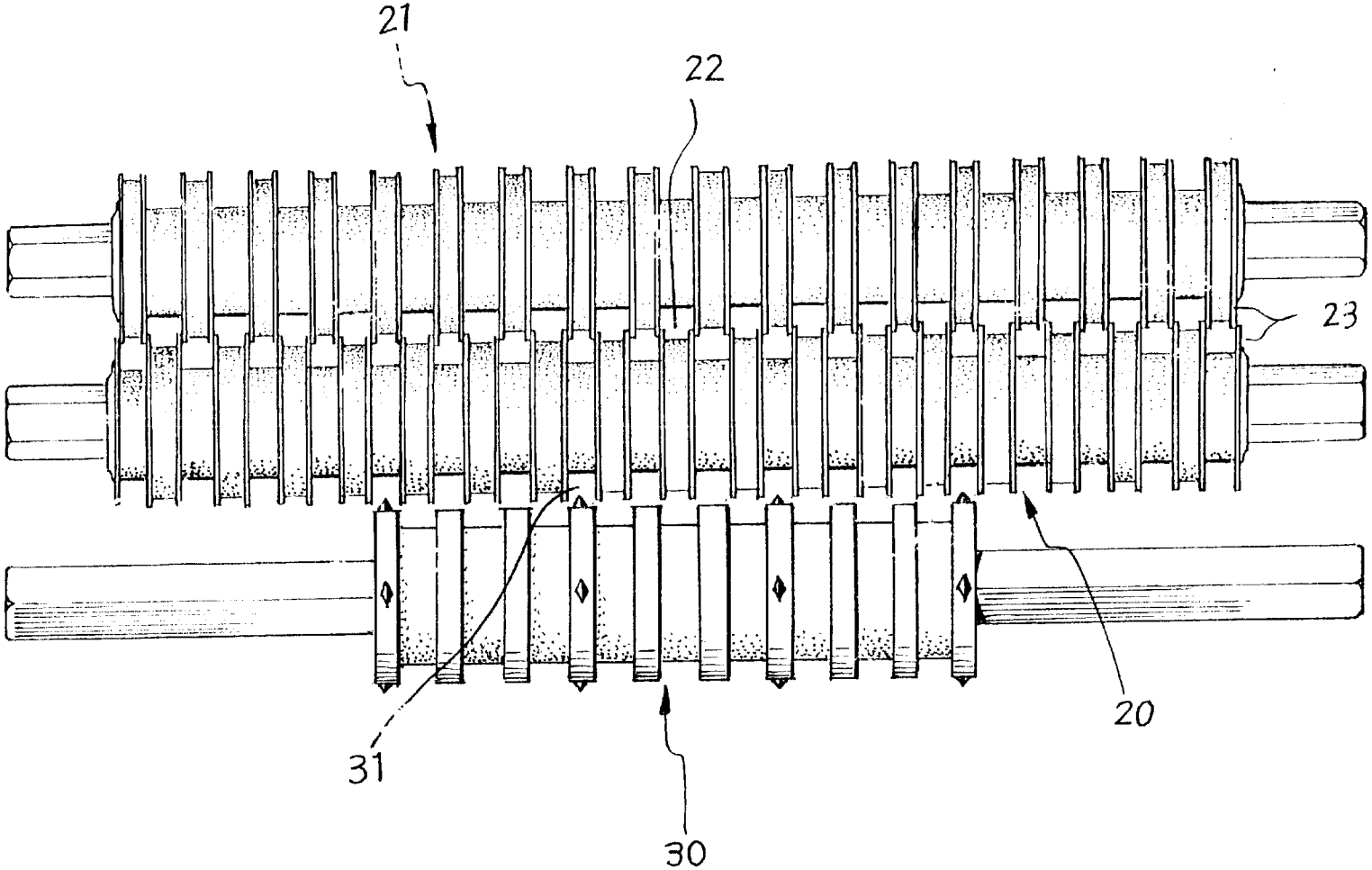
FIG. 2 is a top plan view of rolling blade wheels of the paper shredder having the function of breaking a compact disc as shown in FIG. 1.

Referring to the drawings and initially to FIGS. 1 and 2, a paper shredder 1 having the function of breaking a compact disc in accordance with a preferred embodiment of the present invention comprises a first rolling blade wheel 21 and a second rolling blade wheel 20 which are used for shredding paper. The first rolling blade wheel 21 and the second rolling blade wheel 20 are juxtaposed to each other, and may be rotated relative to each other. A paper shredding zone 22 is formed between the first rolling blade wheel 21 and the second rolling blade wheel 20, and the housing 10 of the paper shredder 1 is formed with a paper inlet 11 aligning with the paper shredding zone 22, such that the paper 40 may be inserted into the paper shredding zone 22 through the paper inlet 11 to be shredded by the first rolling blade wheel 21 and the second rolling blade wheel 20.

A third rolling blade wheel 30 that is especially used for breaking the compact disc is juxtaposed to the second rolling blade wheel 20. A compact disc breaking zone 31 is formed between the second rolling blade wheel 20 and the third rolling blade wheel 30, and the housing 10 of the paper shredder 1 is formed with a compact disc inlet 12 aligning with the compact disc breaking zone 31, such that the compact disc 50 may be inserted into the compact disc breaking zone 31 through the compact disc inlet 12, and the surface of the compact disc 50 may be broken by the second rolling blade wheel 20 and the third rolling blade wheel 30, so as to break the data on the compact disc 50.

Figure 3:
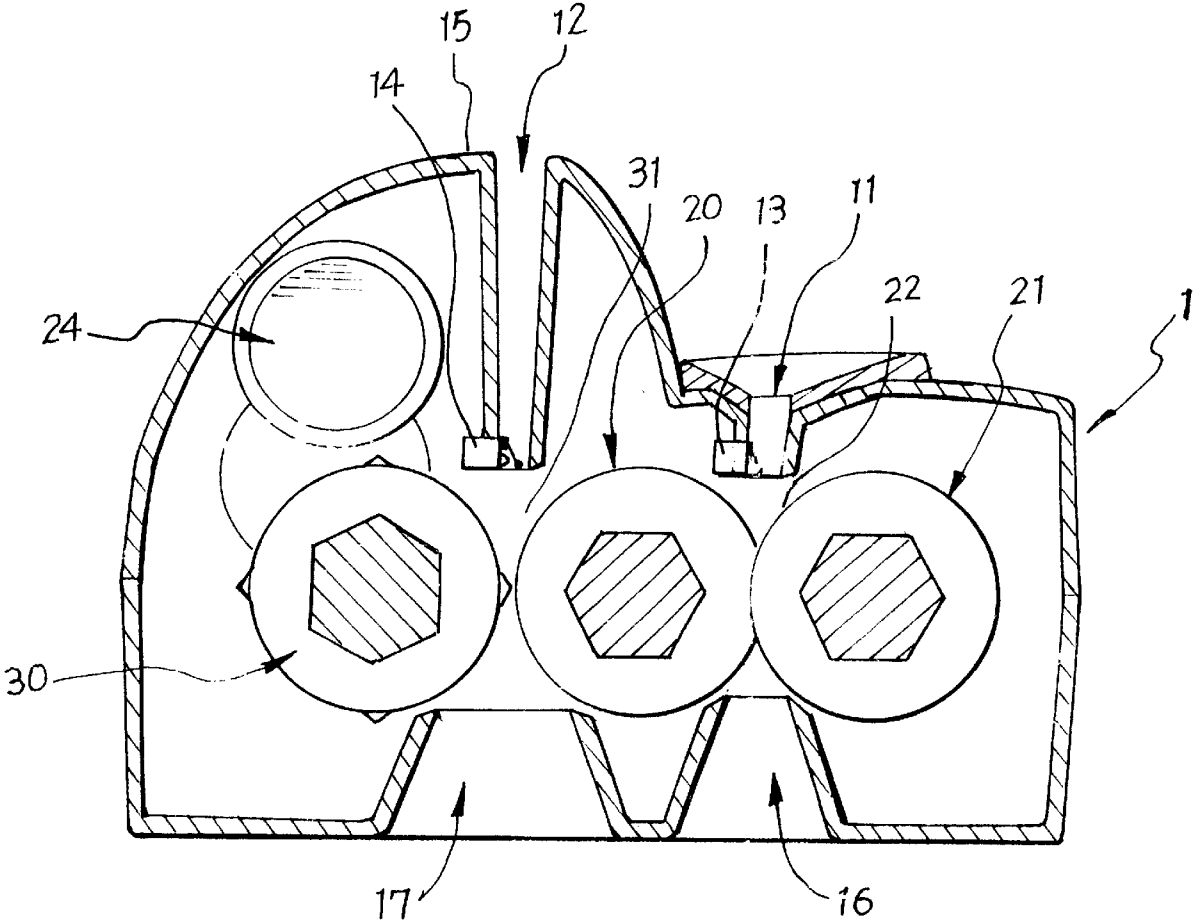
FIG. 3 is a cross-sectional view of the paper shredder having the function of breaking a compact disc as shown in FIG. 1.

As shown in FIGS. 2 and 3, the first rolling blade wheel 21 and the second rolling blade wheel 20 have rolling blades 23 that may be inserted with each other, thereby forming a shearing and cutting effect to chop the paper. On the other hand, the combination of the third rolling blade wheel 30 and the second rolling blade wheel 20 doe not have an outstanding mutual insertion state. As described above, the data on the compact disc 50 may be broken simply by breaking the surface of the compact disc 50, without having to chop the compact disc 50. Thus, the rolling blades 23 having a larger diameter may be arranged on the third rolling blade wheel 30 in a staggered manner, thereby forming tip-shaped blades 32 to break the compact disc 50 by producing dents or curved deformation on the compact disc 50.

Figure 4:
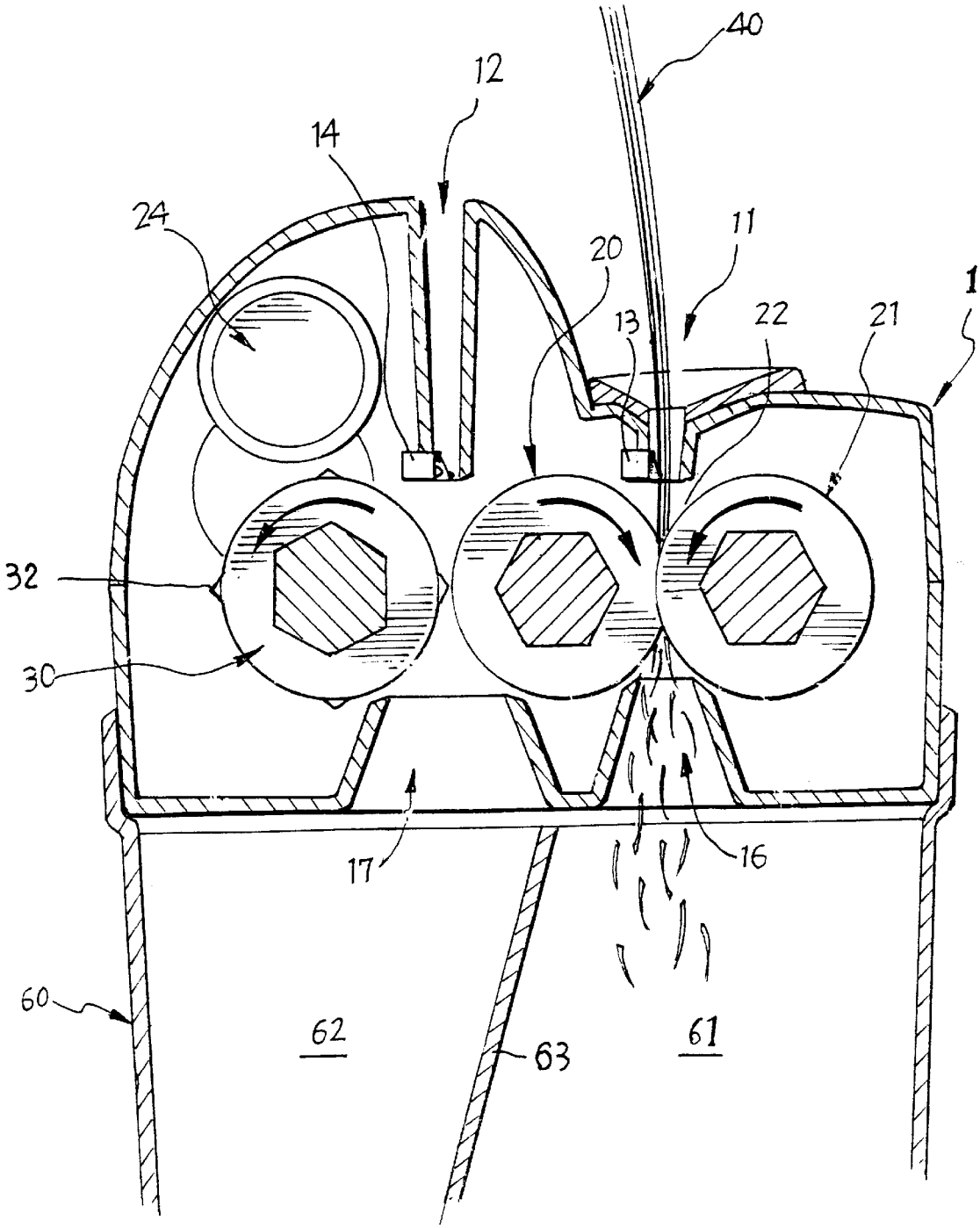
FIG. 4 is a schematic operational view of the paper shredder having the function of breaking a compact disc as shown in FIG. 3 in use.

When the present invention functions as a paper shredder, as shown in FIG. 4, the auto/reverse button (not shown) on the housing 10 may be switched to feed the paper, such that the first rolling blade wheel 21 may be rotated counterclockwise, to drive the second rolling blade wheel 20 to rotate clockwise. Thus, after the paper 40 is inserted into the paper inlet 11 of the housing 10 and touches the microswitch 13, the paper 40 may be inserted into the paper shredding zone 22 through the paper inlet 11 to be clamped between and shredded by the first rolling blade wheel 21 and the second rolling blade wheel 20 that are rotated relative each other, thereby breaking and destroying the paper 40.

At this time, the third rolling blade wheel 30 may be driven by the second rolling blade wheel 20 to rotate counterclockwise, such that if a compact disc 50 is unintentionally inserted into the compact disc breaking zone 31 through the compact disc inlet 12, the compact disc 50 cannot be clamped between the third rolling blade wheel 30 and the second rolling blade wheel 20.

Figure 5:
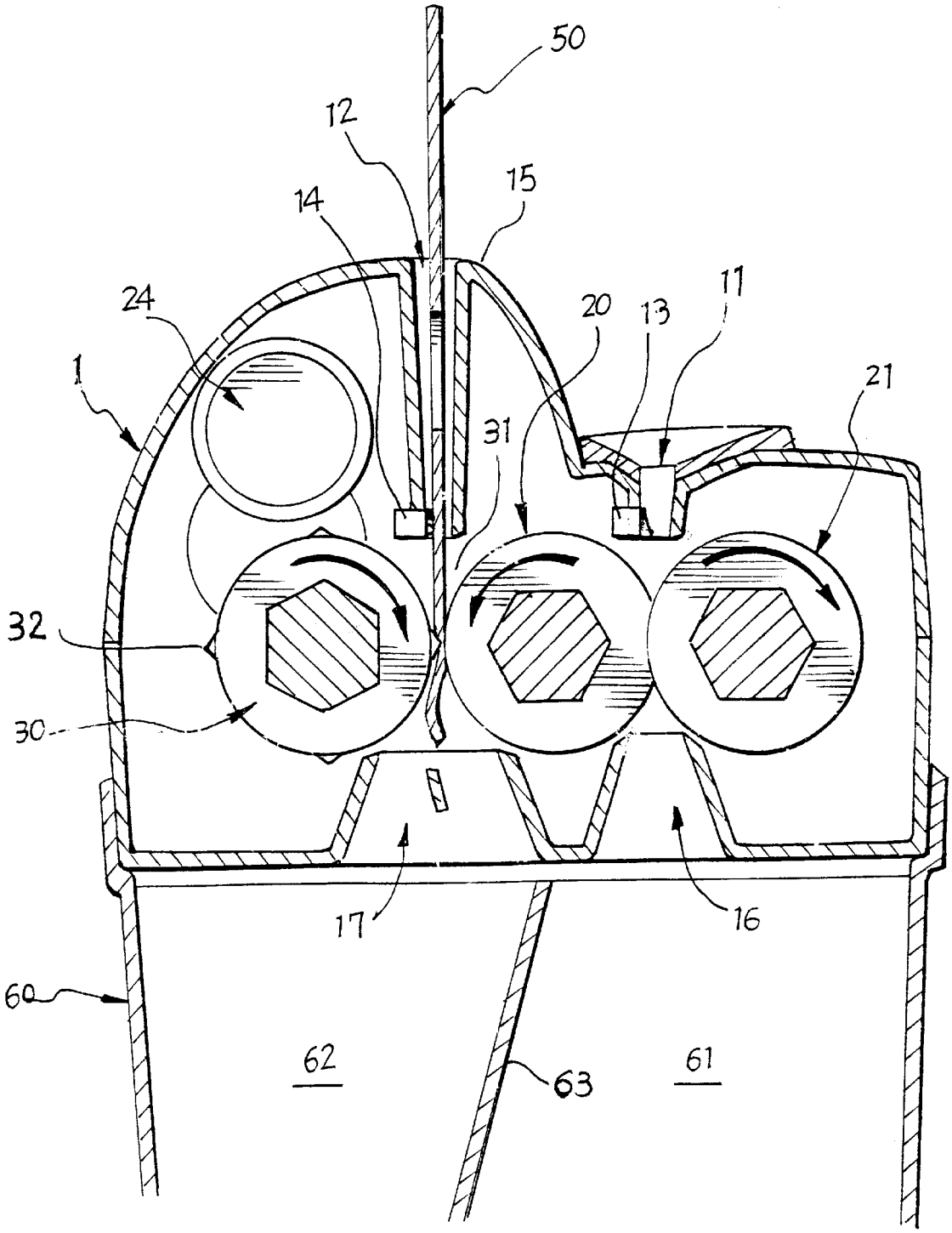
FIG. 5 is a schematic operational view of the paper shredder having the function of breaking a compact disc as shown in FIG. 3 in use.

Relatively, when the present invention is used to break the compact disc 50, as shown in FIG. 5, the auto/reverse button (not shown) on the housing 10 may be switched to withdraw the paper, such that the first rolling blade wheel 21 may be rotated clockwise, to drive the second rolling blade wheel 20 to rotate counterclockwise, while the third rolling blade wheel 30 may be driven by the second rolling blade wheel 20 to rotate clockwise. Thus, after the compact disc 50 is inserted into the compact disc inlet 12 of the housing 10 and touches the microswitch 14, the compact disc 50 may be inserted into the compact disc breaking zone 31 through the compact disc inlet 12 to be clamped between the second rolling blade wheel 20 and the third rolling blade wheel 30 that are rotated relative each other, to break the surface of the compact disc 50 by scraping, denting, bending or deforming, thereby breaking and destroying the electronic storage medium data on the compact disc 50.

At this time, the first rolling blade wheel 21 is rotated clockwise, and the second rolling blade wheel 20 is rotated counterclockwise, such that if the paper 40 is unintentionally inserted into the paper shredding zone 22 through the paper inlet 11, the paper 40 cannot be clamped between and shredded by the first rolling blade wheel 21 and the second rolling blade wheel 20.

In summary, the paper 40 and the compact disc 50 cannot be broken simultaneously, thereby preventing the personal erroneous operation.

In addition, as shown in FIGS. 1 and 3, one side or two sides of the compact disc inlet 12 of the housing 10 may be formed with a guard side 15 protruded from the compact disc inlet 12. The guard side has a height which is designed such that, even if the user's one finger is inserted into the central hole of the compact disc 50, and the compact disc 50 is inserted into the compact disc inlet 12, the edge of the compact disc 50 cannot touch the microswitch 14, thereby preventing from starting the motor 24, so as to protect the user's safety (especially for the child).

As shown in FIGS. 4 and 5, the paper shredder 1 has a lower portion provided with a waste outlet 16 and a waste outlet 17 to align with the paper shredding zone 22 and the compact disc breaking zone 31 respectively. A baffle 63 is mounted in a container 60, thereby dividing the container 60 into a waste paper zone 61 and a waste compact disc zone 62 to align with the waste outlet 16 and the waste outlet 17 respectively, thereby facilitating recycling and recovering the resource.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A paper shredder having the function of breaking a compact disc, comprising: a first rolling blade wheel and a second rolling blade wheel which are used for shredding paper, the first rolling blade wheel and the second rolling blade wheel juxtaposed to each other, and rotated relative to each other, a paper shredding zone formed between the first rolling blade wheel and the second rolling blade wheel, a housing above the paper shredding zone formed with a paper inlet aligning with the paper shredding zone, such that paper may be inserted into the paper shredding zone through the paper inlet to be shredded by the first rolling blade wheel and the second rolling blade wheel; wherein, a third rolling blade wheel that is especially used for breaking a compact disc is juxtaposed to the second rolling blade wheel, a compact disc breaking zone is formed between the second rolling blade wheel and the third rolling blade wheel, and the housing is formed with a compact disc inlet aligning with the compact disc breaking zone, such that the compact disc may be inserted into the compact disc breaking zone through the compact disc inlet, and a surface of the compact disc may be broken by the second rolling blade wheel and the third rolling blade wheel, so as to break data on the compact disc.

2. The paper shredder having the function of breaking a compact disc in accordance with claim 1, wherein the third rolling blade wheel is provided with rolling blades having a larger diameter which are arranged in a staggered manner, thereby forming tip-shaped blades to break the compact disc.

3. The paper shredder having the function of breaking a compact disc in accordance with claim 1, wherein one side or two sides of the compact disc inlet is formed with a guard side protruded from the compact disc inlet, and the guard side has a height which is designed such that, even if a user's one finger is inserted into a central hole of the compact disc, and the compact disc is inserted into the compact disc inlet, an edge of the compact disc cannot touch a microswitch, thereby preventing from starting a motor.

4. The paper shredder having the function of breaking a compact disc in accordance with claim 1, wherein the paper shredder has a lower portion provided with a paper waste outlet and a disc waste outlet aligned with the paper shredding zone and the compact disc breaking zone respectively, and a baffle is mounted in a container, thereby dividing the container into a waste paper zone and a waste compact disc zone to align with the paper waste outlet and the disc waste outlet respectively, thereby facilitating recycling and recovering resource.

* * * * *